US008590350B2

(12) United States Patent
Clausen

(10) Patent No.: US 8,590,350 B2
(45) Date of Patent: Nov. 26, 2013

(54) DEVICE FOR THE SITUATION-DEPENDENT AUTHORIZED ADMISSION OR ACCESS TO ANY CASING AND PROTECTION OF SAID CASING AGAINST MISUSE OF THE CONTENT

(75) Inventor: David G. Clausen, Bochum (DE)

(73) Assignee: medic assist GmbH & Co. KG, Bochum (DE)

( * ) Notice: Subject to any disclaimer, the term of this patent is extended or adjusted under 35 U.S.C. 154(b) by 0 days.

(21) Appl. No.: 13/582,986

(22) PCT Filed: Mar. 3, 2011

(86) PCT No.: PCT/DE2011/000221

§ 371 (c)(1),
(2), (4) Date: Nov. 10, 2012

(87) PCT Pub. No.: WO2011/107083

PCT Pub. Date: Sep. 9, 2011

(65) Prior Publication Data

US 2013/0047684 A1 Feb. 28, 2013

(30) Foreign Application Priority Data

Mar. 5, 2010 (DE) ..... 10 2010 010 542

(51) Int. Cl.
*E05B 65/10* (2006.01)

(52) U.S. Cl.
USPC ..... 70/92; 70/208; 70/210; 70/379 R; 70/422; 70/465; 292/21; 292/92

(58) Field of Classification Search
USPC ..... 70/92, 465, 422, 208, 210, 86, 134, 70/379 R, 379 A, 380; 292/21, 92, DIG. 31, 292/DIG. 65
See application file for complete search history.

(56) References Cited

U.S. PATENT DOCUMENTS

| | | | | | |
|---|---|---|---|---|---|
| 1,372,008 | A | * | 3/1921 | Darr | 70/447 |
| 2,275,362 | A | * | 3/1942 | Golden et al. | 70/134 |
| 2,278,044 | A | * | 3/1942 | Scanlan | 70/134 |
| 2,331,105 | A | * | 10/1943 | Edward | 70/156 |
| 2,354,321 | A | * | 7/1944 | Kornrumpf | 70/465 |
| 2,427,281 | A | * | 9/1947 | Holanbek et al. | 70/465 |
| 2,473,205 | A | * | 6/1949 | Jazwieck | 292/341.17 |
| 2,607,313 | A | * | 8/1952 | Eads | 116/75 |
| 3,006,179 | A | * | 10/1961 | Erickson | 70/129 |
| 3,104,539 | A | | 9/1963 | Cutler | |
| 3,349,585 | A | * | 10/1967 | Walters | 70/86 |
| 3,595,044 | A | | 7/1971 | Hicks | |
| 3,660,940 | A | * | 5/1972 | Tavano | 49/366 |

(Continued)

FOREIGN PATENT DOCUMENTS

| | | |
|---|---|---|
| DE | 310919 | 2/1919 |
| DE | 32 40 633 C1 | 6/1984 |

(Continued)

*Primary Examiner* — Lloyd Gall
(74) *Attorney, Agent, or Firm* — Smartpat PLC; Axel Nix

(57) ABSTRACT

A locking mechanism for the situation-dependent authorized admission or access to any casing and the protection of the casing against misuse of its contents is disclosed. The locking mechanism comprises at least one rotatable locking member (1) and at least one latch member (2) which can be unlocked by the rotatable locking member (1). In case of an emergency the latch member (2) is accessible also through a breakable barrier (3) and can be manually moved after the barrier (3) has been irreversibly destroyed.

11 Claims, 2 Drawing Sheets

(56) References Cited

U.S. PATENT DOCUMENTS

| | | | | | |
|---|---|---|---|---|---|
| 3,824,817 | A | * | 7/1974 | Orr | 70/81 |
| 4,046,412 | A | | 9/1977 | Lee | |
| 4,164,095 | A | * | 8/1979 | Musacchia | 52/1 |
| 4,321,812 | A | * | 3/1982 | Pelcin | 70/472 |
| 4,347,721 | A | * | 9/1982 | Borgman | 70/380 |
| 4,580,818 | A | * | 4/1986 | Lyng | 292/148 |
| 4,969,343 | A | | 11/1990 | Luker | |
| 4,986,576 | A | * | 1/1991 | Anderson | 292/40 |
| 5,212,972 | A | * | 5/1993 | Kincaid et al. | 70/208 |
| 5,768,921 | A | * | 6/1998 | Hill | 70/63 |
| 6,550,831 | B2 | * | 4/2003 | Rizk | 292/336.3 |

FOREIGN PATENT DOCUMENTS

| | | |
|---|---|---|
| FR | 2701285 | 8/1994 |
| GB | 15 71 823 A | 7/1980 |
| GB | 20 51 217 A | 1/1981 |
| GB | 2205894 | 12/1988 |

* cited by examiner

DEVICE FOR THE SITUATION-DEPENDENT AUTHORIZED ADMISSION OR ACCESS TO ANY CASING AND PROTECTION OF SAID CASING AGAINST MISUSE OF THE CONTENT

TECHNICAL FIELD

The present disclosure generally relates to a locking mechanism for a casing, and more particularly, to a locking mechanism for a casing providing emergency access to the casing through a breakable barrier and service access by operating a rotatable locking member.

BACKGROUND

It is known that a given container may contain devices or objects which must be removable by anybody in an emergency, but which must be protected in a suitably deterrent manner against theft or unauthorized access.

This conflict has thus far not been adequately resolved. Key-based systems do not guarantee access to any arbitrary person. Open systems, with e.g. mechanical or electromechanical closing mechanisms, provide no protection and no inhibition against opening. In an open system a container may be restored without damage to its original, intact exterior condition, after e.g. the opening and unlawful removal or modification of the contents of the container. From a legal standpoint, the potential applicable penalty is also limited thereby. No aggravated theft has been committed, as the contents of the container do not in legal terms represent an item subject to special protection against removal in the meaning of e.g. Sect. 243 Para. 2 of the German Criminal Code. In addition, care must be taken that service access is not hindered by anti-theft precautions.

SUMMARY

A locking mechanism is presented which allows situation-dependent authorized admission and emergency access to a casing, providing protection of said casing against misuse of its contents. The locking mechanism comprises at least one rotatable locking member and at least one latch member which can be engaged and/or disengaged by the rotatable locking member. Possible rotatable locking members for the present invention include all devices which permit or prevent the engagement and/or disengagement of the latch member by means of mechanical, electromechanical, or other physical principles, e.g. by means of a suitable key or a numerical code. Possible keys include all mechanical, electronic, or electromagnetic devices suitable for operating the rotatable locking member according to the state of the art. The term "casing" as used herein is understood to mean all substantially solid covers suited to protectively surround some contents, e.g. containers or enclosed spaces. The disclosed locking mechanism allows anybody to gain access to casings, and specifically containers, in an emergency. It is easy to operate even in stressful situations, while simultaneously affording protection against theft and increasing the level of inhibition against theft. The disclosed locking mechanism does not restrict service access to the casing.

The aforementioned task is solved in accordance with the invention with the features of the independent claims. Advantageous embodiments of the mechanism in accordance with the invention are indicated in the dependent claims.

A mechanism of the type previously mentioned is thus characterized in that at least one barrier is provided on the casing in the access opening of one or more latch members. The at least one barrier may be overcome by means of at least one mechanical and/or electromechanical protector or covering which may be actuated manually, causing irreversible deformation/destruction of the barrier to provide access to at least one latch member.

In a particularly advantageous embodiment of the invention, this barrier comprises a breakable pane of glass, as is already employed as a simple means of access protection for emergency alarms. Once the pane has been smashed and its fragments have fallen into an optional collecting device, access to an (alarm) activation mechanism is available.

Non-time-critical access, e.g. for service purposes, may be provided e.g. via a key-actuated lock or any other opening mechanism not requiring a barrier; to protect against misuse, more strongly protected opening mechanisms (standard mechanisms) are appropriate here. Preferably, both methods provide access to the same (or to an interconnected) latch member.

BRIEF DESCRIPTION OF THE DRAWINGS

Further objectives, features, advantages, and possible applications of the mechanism in accordance with the invention may be discerned from the following description of an exemplary embodiment with the aid of the drawings.

DETAILED DESCRIPTION

Figure 1:
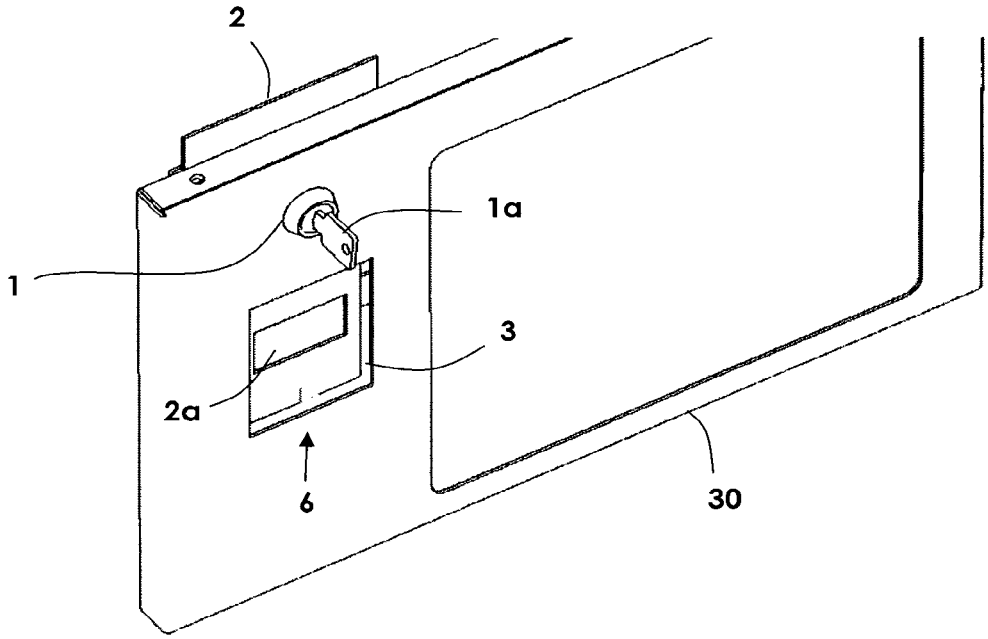
FIG. 1 is a perspective view of the mechanism in accordance with the invention on a casing door 30.

FIG. 1 depicts in perspective view a hinged or tiltable casing door 30. The casing door 30 can be locked by engaging a latch member 2 which is slidably disposed at a base plate 5 at the rear of the casing door 30. The latch member 2, when locked, extends beyond the casing door 30 and is held in this locked position by springs 4. The casing door 30 is to be understood as meaning any device covering the casing, regardless of whether arranged in such a manner as to be articulable, and which, in an extreme case, may substitute for the casing.

Figure 2:
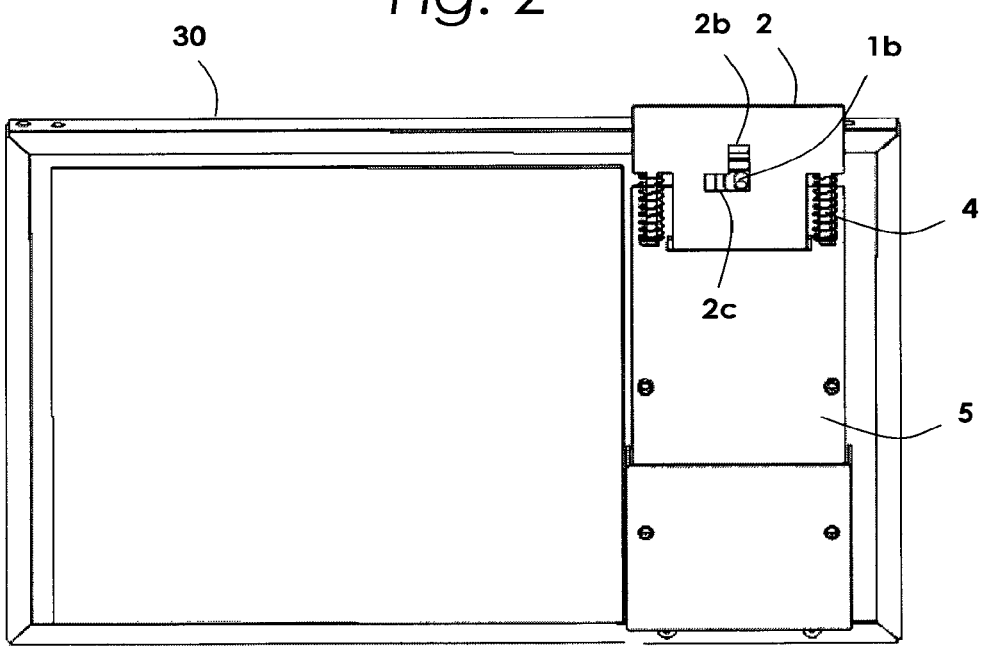
FIG. 2 is a rear view of the mechanism as in FIG. 1.
Figure 3:
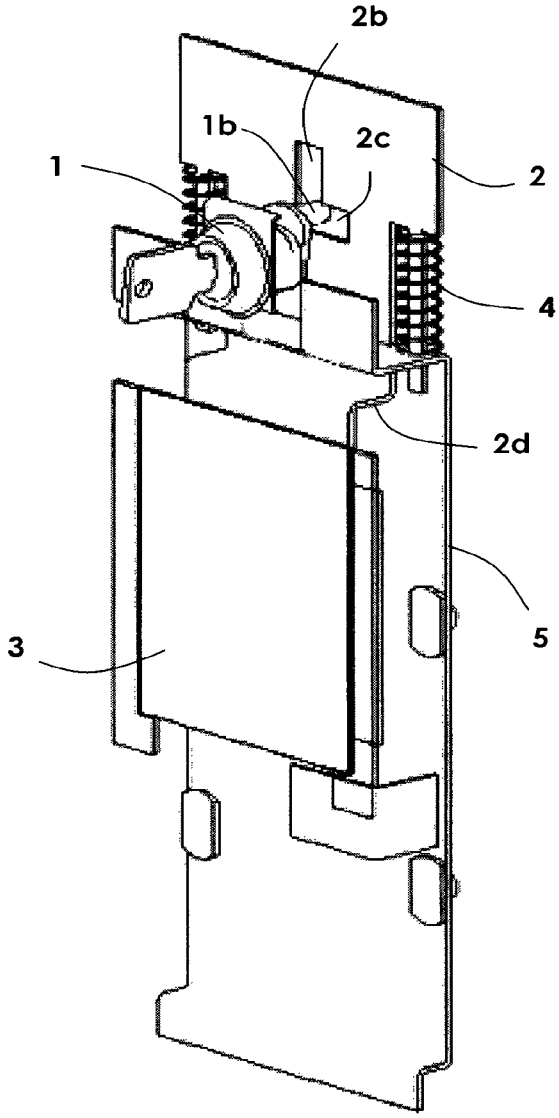
FIG. 3 is a detailed perspective view of the mechanism as represented in FIG. 1 and FIG. 2.

The latch member 2 is actuated during authorized access/admission via the rotatable locking member 1 by means of a conventional key 1*a*. As shown in FIG. 2 and FIG. 3 a substantially L-shaped cutout is provided in the latch member 2, comprising a longitudinal slot 2*b* and a lateral slot 2*c*. A pin 1*b* is eccentrically disposed at the back of the rotatable locking member 1 and engages the longitudinal cutout 2*b* or lateral cutout 2*c*.

Through turning the rotatable locking member 1, the latch member 2 is either closed by means of spring force (pin 1*b* engages the longitudinal cutout 2*b*) or pushed downward against the spring force (pin 1*b* engages the lateral cutout 2*c*) and the latch member 2 thereby unlocked.

In the event of an unauthorized access, the latch member 2 is unlocked after destruction of the barrier 3 by manual movement (pulling or pushing) of the slidable latch member 2, e.g. by means of a handle or gripping element or comparable device which is disposed on the latch member 2.

Figure 4:
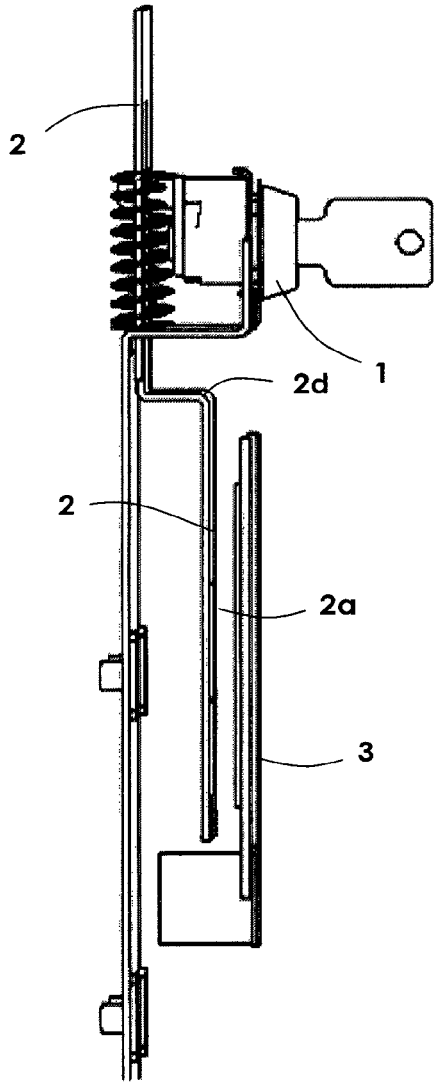
FIG. 4 is a side view of the mechanism.

As depicted in FIGS. 3 and 4, the rotatable locking member 1 and the latch member 2 are arranged on the mechanism such that the latch member 2 is moved longitudinally into the unlocked position. Movement of the latch member 2 is affected either by pulling or pushing or, during the authorized unlocking of the movable latch member 2, by rotation of the rotatable locking member 1.

The exclusively longitudinal movement of the latch member 2 permits an especially flat profile for the mechanism. This is of basic practical importance, as a flat profile for the mechanism thus also permits an especially flat profile for the relevant casing, thus representing no obstacle when installed in the vicinity of emergency exits, etc. The flatter the structure of the mechanism, the more advantageous for its installation and accessibility in critical, and particularly in narrow access areas and escape pathways.

The locking mechanism comprises a latch member 2 having a flat profile and a base plate 5 having a comparably flat profile, the latch member 2 being slidable parallel to the base plate 5. As depicted in FIG. 4, the barrier 3 of the mechanism is also flat and arranged substantially in parallel with the base plate 5 and the latch member 2.

In the event of an unauthorized admission, pin 1*b* in this embodiment is preferably located—as depicted in FIG. 3—in the longitudinal cutout 2*b*, so that the rotatable locking member 1 is not affected by the manual actuation of the latch member 2.

Both in the event of manual access after the destruction of the barrier 3 and of access by means of the rotatable locking member 1, the latch member 2 is actuated in such a way that the use of separate locking and unlocking mechanisms is not necessary. Accordingly, the mechanism is designed to be technically simple and cost-effective.

In one particularly advantageous embodiment, the barrier 3 is formed in such a way that access to the latch member 2 is provided only upon the complete destruction of the barrier 3. Especially advantageous in this case, the access opening 6 for the latch member 2 is made completely accessible by the destruction of the barrier 3.

The disclosed embodiment further ensures that, in the event of the destruction of the barrier 3, ideally a pane, and subsequent purloin (removal for purposes other than those intended) of an object, such removal will be classified in certain countries and by some insurance policies as breaking and entering (here, breaking open a container in a room of a building). In general, this would not be the case for the destruction of a barrier 3 or removal of a seal in some way pre-prepared or primed for such destruction or removal (e.g. groove, tear-off edge, breaking edge, break point, break-off edge, etc.) (such removal or destruction not constituting a breaking open in accordance with the above definition). This embodiment is, e.g. through the destruction of a pane 3 as a barrier not specially prepared for such destruction, thus particularly advantageous for purposes of insuring against burglary. This advantage results in more open availability and thus increased access, and an associated increase in efficiency in emergency situations.

Use is also made of natural psychological inhibitions. As a barrier 3 must be destroyed in order to gain access to the latch member 2, the destruction of which is associated with a risk of injury for the user (injury from glass shards, etc.), it may naturally be assumed that the barrier 3 will primarily be breached by the user for uses in keeping with its intended purpose, in which the danger of injury is counterbalanced by the benefit (in this case e.g. to obtain access to a product for use in an acute emergency, such as a mobile medical device, a rescue device, or a means of mitigating a dangerous situation). In addition, when destroying a barrier 3 not specifically prepared for such destruction, such as is made of glass in the particularly advantageous embodiment, the user must calculate with the generation of sound likely to be perceived by others as an indication of an event deserving of special notice, thus increasing the risk of discovery (the sound of breaking glass being associated with situations such as burglary, vandalism, accidents, etc.). This serves as an additional deterrent against use for a purpose other than that intended. In the case of a pre-prepared barrier 3, such as e.g. a glass pane with a break point, the user need not expect such a sound to be generated. As a result of these characteristics of the mechanism, the owner of the item to be kept as accessible as possible in the event of emergency is encouraged to position the casing in the ideal location for such an emergency (rather than in the most secure and easily monitored location), thus significantly increasing its efficiency (e.g. survival rate, damage limitation).

In the particularly advantageous embodiment, use is also made of the fact that the actions of pulling on a lever/catch in an emergency situation (e.g. emergency brake on a train, opening of emergency exits, etc.) and of breaching a barrier 3, as in this case a glass pane, for other emergency purposes such as sounding an alarm (e.g. a fire alarm) are already widespread and familiar. Accordingly, this combination leads to increased acceptance and, in the special case of an emergency situation, to a more intuitive use. As time is usually the decisive factor in an emergency situation, the invention should be considered particular efficient and advantageous.

As shown in FIG. 3 and FIG. 4, the latch member 2 exhibits a deformation 2*d* below the rotatable locking member 1 such that the latch member 2 projects at least some distance from the base plate 5 at the point suitable for access. This embodiment permits the user's fingers to more easily grasp the latch member 2.

As shown in FIG. 1, the latch member 2 exhibits in the access opening 6 an handle opening 2*a*, by means of which the latch member 2 can be manually pushed downward, e.g. with the fingers.

The latch member 2 may also function as an attachment for the casing door 30. The latch member 2 is located on the casing e.g. in such a way that the unlocking of the rotatable locking member 1 permits the casing door 30 to be removed from the casing.

By covering the rotatable locking member 1 with the barrier 3, ideally a breakable glass pane, an additional moral, practical, and legal inhibition is created. The moral inhibition is a consequence of the construction, which is shared with emergency alarms. The practical inhibition is a consequence of the necessary destruction of material, in this case glass. This requires not only strength, but also care, and additionally generates in the form of the shattering sound an acoustic signal audible to third parties, which may additionally be supplemented by other signals of whatever type in the rotatable locking member 1 or in the opening of the casing.

The mechanism may be used with casings housing emergency equipment. Emergency equipment must be available at any time and within seconds for any first responder, e.g. fire extinguishers. At the same time, such an item of emergency equipment has a high market value, creating a danger of a quick removal. In the case of a simple, weather-protective storage solution, such a removal would only constitute theft in the meaning of Sect. 242 StGB. Through the use of the mechanism in accordance with the invention on a container suited for storing an emergency apparatus, unjustified removal of emergency apparatus would be largely avoided due to the increased inhibition created.

The mechanism in accordance with the invention is not restricted in its realization to the preferred embodiments listed above. Rather, a multitude of different embodiments are conceivable which might make use of the solution represented despite fundamentally different implementation.

LIST OF REFERENCE NUMBERS FOR ILLUSTRATIONS

1 Rotatable locking member
1*a* Key
1*b* Pin on 1
2 Latch member
2*a* Handle opening on 2
2*b*; 2*c* Cutouts on 2
2*d* Deformation on 2*a*
3 Barrier (glass pane)
4 Springs
5 Base plate
6 Access opening
30 Casing door

The invention claimed is:

1. A locking mechanism for a casing, comprising
a base plate (5) attached to a door (30) of the casing;
a latch member (2) slidably connected to the base plate (5), said latch member comprising a substantially L-shaped cutout comprising a longitudinal slot (2*b*) and a lateral slot (2*c*);
at least one spring (4) disposed between the base plate (5) and the latch member (2);
a rotatable locking member (1);
a pin (1*b*) connected eccentrically to the rotatable locking member (1), the pin (1*b*) being arranged to engage the substantially L-shaped cutout of the latch member (2); and
an access opening (6) in the door (30) of the casing providing access to the latch member (2), the access opening being secured by a breakable barrier (3),
wherein the latch member (2) is pushed into a locked position by the at least one spring (4) when the pin (1*b*) is positioned within the longitudinal slot (2*b*),
and wherein the latch member (2) can be moved longitudinally into an unlocked position by either
manual movement of the latch member (2) after breaking the barrier while the pin remains in the longitudinal slot (2*b*) or
by rotation of the rotatable locking member (1), causing the pin (1*b*) to slide sideways within the lateral slot (2*c*) while moving the latch member (2) longitudinally.

2. The locking mechanism for a casing as in claim 1, wherein the barrier (3) comprises at least one breakable pane.

3. The locking mechanism for a casing as in claim 2, wherein the at least one breakable pane is transparent.

4. The locking mechanism for a casing as in claim 1, wherein the latch member (2) becomes accessible from outside by destruction of the barrier (3).

5. The locking mechanism for a casing as in claim 1, wherein the access opening (6) for the latch member (2) is uncovered by destruction of the barrier (3).

6. The locking mechanism for a casing as in claim 1, wherein the rotatable locking member (1) can be rotated by turning a key (1*a*) which can be inserted from outside the casing into the rotatable locking member (1).

7. The locking mechanism for a casing as in claim 1, wherein the latch member comprises a handle opening (2*a*) which a user can grasp after destruction of the barrier (3) to unlock the casing.

8. The locking mechanism for a casing as in claim 7, wherein the latch member (2) comprises a deformation (2*d*) which positions the handle opening (2*a*) at a distance from the base plate (5), thereby allowing a user's fingers to easily grasp the handle opening (2*a*).

9. The locking mechanism for a casing as in claim 1, wherein the latch member (2) functions as an attachment and the door (30) becomes disconnected from the casing upon unlocking the latch member (2).

10. The locking mechanism for a casing as in claim 1, wherein the barrier (3) has a flat profile and is arranged parallel to the base plate (5) and the latch member (2).

11. The locking mechanism for a casing as in claim 1, wherein the manual movement of the latch member (2) after breaking the barrier while the pin remains in the longitudinal slot (2*b*) is a downward movement.

* * * * *